US010167614B2

(12) United States Patent
Thekanath et al.

(10) Patent No.: US 10,167,614 B2
(45) Date of Patent: Jan. 1, 2019

(54) SYSTEM AND METHOD FOR CONTROLLING HYDRAULIC COMPONENTS OF A WORK VEHICLE BASED ON STORED ELECTRO-HYDRAULIC SETTINGS

(71) Applicant: CNH Industrial America, LLC, New Holland, PA (US)

(72) Inventors: Sebastian Thekanath, Darien, IL (US); Subramanian Arunachalam, Bolingbrook, IL (US); Timothy Newlin, Wichita, KS (US); Scott Eisfeldt, Arlington Heights, IL (US); Joel Garcia, Chicago, IL (US)

(73) Assignee: CNH Industrial America LLC, New Holland, PA (US)

( * ) Notice: Subject to any disclaimer, the term of this patent is extended or adjusted under 35 U.S.C. 154(b) by 803 days.

(21) Appl. No.: 14/467,112

(22) Filed: Aug. 25, 2014

(65) Prior Publication Data

US 2015/0135695 A1 May 21, 2015

Related U.S. Application Data

(60) Provisional application No. 61/905,905, filed on Nov. 19, 2013.

(51) Int. Cl.

| | |
|---|---|
| ***F15B 21/02*** | (2006.01) |
| ***E02F 9/22*** | (2006.01) |
| ***E02F 3/34*** | (2006.01) |
| ***E02F 9/26*** | (2006.01) |

(52) U.S. Cl.

CPC ..... *E02F 9/2253* (2013.01); *E02F 3/3414* (2013.01); *E02F 9/26* (2013.01); *F15B 2211/6346* (2013.01); *F15B 2211/6654* (2013.01); *F15B 2211/6658* (2013.01); *F15B 2211/75* (2013.01); *F15B 2211/78* (2013.01)

(58) Field of Classification Search

None

See application file for complete search history.

(56) References Cited

U.S. PATENT DOCUMENTS

| | | | | |
|---|---|---|---|---|
| 6,343,237 | B1 | 1/2002 | Rossow et al. | |
| 7,496,441 | B2 | 2/2009 | Brandt et al. | |
| 2007/0038355 | A1* | 2/2007 | Brandt ..... | E02F 3/3414 701/50 |

* cited by examiner

*Primary Examiner* — Jelani A Smith
*Assistant Examiner* — Paul A Castro
(74) *Attorney, Agent, or Firm* — Peter K. Zacharias; Patrick M. Sheldrake

(57) ABSTRACT

A method for controlling the operation of at least one hydraulic component of a work vehicle may generally include storing, with a computing device, a first electro-hydraulic setting and a second electro-hydraulic setting for the hydraulic component. The first electro-hydraulic setting may be associated with at least one of a pre-defined speed setting or a pre-defined sensitivity setting. The second electro-hydraulic setting may be associated with at least one of an operator-defined speed setting or an operator-defined sensitivity setting. In addition, the method includes receiving an input associated with an operator's selection of the first electro-hydraulic setting or the second hydraulic setting and controlling the operation of the hydraulic component in accordance with the first electro-hydraulic setting or the second electro-hydraulic setting based on the operator's selection.

16 Claims, 7 Drawing Sheets

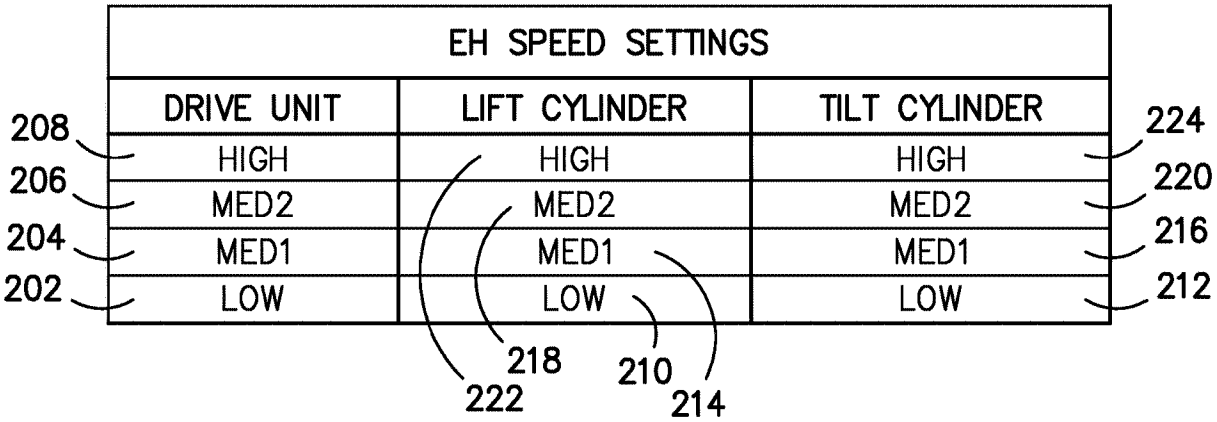
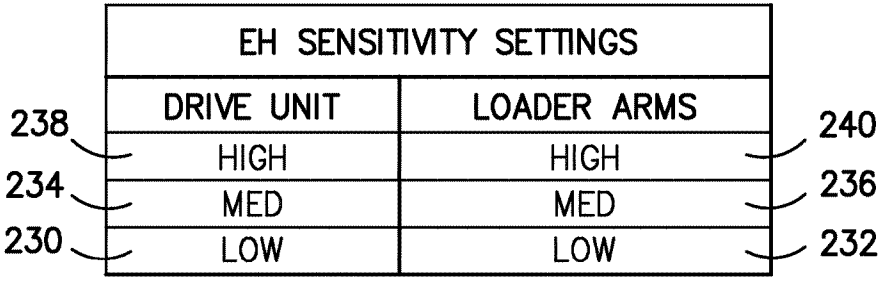
*FIG. —4—*

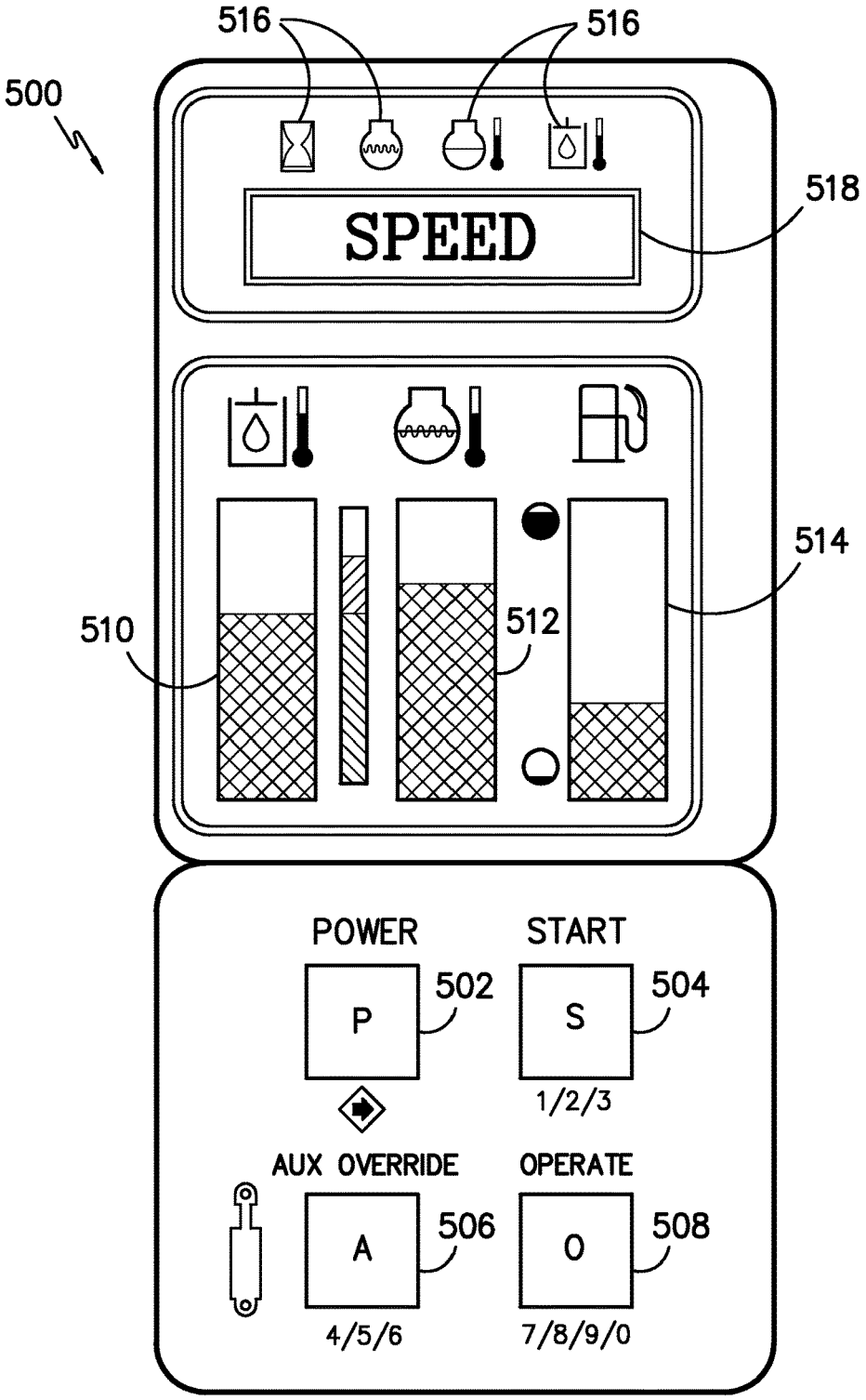
FIG. —7—

SYSTEM AND METHOD FOR CONTROLLING HYDRAULIC COMPONENTS OF A WORK VEHICLE BASED ON STORED ELECTRO-HYDRAULIC SETTINGS

FIELD OF THE INVENTION

The present subject matter relates generally to work vehicles and, more particularly, to a system and method for controlling one or more hydraulic components of a work vehicle based on electro-hydraulic settings stored within the memory of the vehicle's controller.

BACKGROUND OF THE INVENTION

Conventional work vehicles generally include various hydraulic components. For example, a skid steer loader typically includes a hydrostatic drive unit having one or more hydraulic pumps and motors for controlling the rotational speed and/or direction of the wheels of the loader. In addition, skid steer loaders typically include one or more hydraulic cylinders for adjusting the position of an implement coupled to loader arms of the loader. For instance, a lift cylinder(s) may be provided for raising and lowering the implement relative to the ground and a tilt cylinder(s) may be provided for tilting or pivoting the implement relative to the ground.

To provide for variation in the control of the various hydraulic components, work vehicles are often provided with several manufacturer-defined electro-hydraulic (EH) settings (e.g., a high, medium and low setting). In such instances, the EH settings are fixed or otherwise permanent and, thus, may not be changed by the operator. As a result, operators lack the ability to customize the vehicle's EH settings in order to adapt the operation of the hydraulic components to the manner of operation desired by the operator. Moreover, the current methodologies for selecting one of the manufacturer-defined EH settings are often cumbersome and time-intensive for the operator, thereby increasing vehicle downtime when an operator desires to switch between two of the settings.

Accordingly, a system and method that allows for a plurality of different EH settings, including manufacture-defined settings and operator-customized settings, to be stored within the memory of a work vehicle's controller and subsequently accessed/selected by an operator in a quick and effective manner would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a computer-implemented method for controlling the operation of at least one hydraulic component of a work vehicle. The method may generally include storing, with a computing device, a first electro-hydraulic setting and a second electro-hydraulic setting for the hydraulic component. The first electro-hydraulic setting may be associated with at least one of a pro-defined speed setting or a pre-defined sensitivity setting. The second electro-hydraulic setting may be associated with at least one of an operator-defined speed setting or an operator-defined sensitivity setting, In addition, the method includes receiving an input associated with an operator's selection of the first electro-hydraulic setting or the second hydraulic setting and controlling the operation of the hydraulic component in accordance with the first electro-hydraulic setting or the second electro-hydraulic setting based on the operator's selection.

In another aspect, the present subject matter is directed to a system for controlling one or more components of a work vehicle. The system may generally include at least one hydraulic component and a controller communicatively coupled to the at least one hydraulic. component, The controller may be configured to store a first electro-hydraulic setting and a second electro-hydraulic setting for the hydraulic component. The first electro-hydraulic setting may be associated with at least one of a pre-defined speed setting or a pre-defined sensitivity setting. The second electro-hydraulic setting may be associated with at least one of an operator-defined speed setting or an operator-defined sensitivity setting, In. addition, the controller may be configured to receive an input associated with an operator's selection of the first electro-hydraulic setting or the second hydraulic setting and control the operation of the hydraulic component in accordance with the first electro-hydraulic setting or the second electro-hydraulic setting based on the operator's selection.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 4 illustrates a chart providing example electro-hydraulic settings that may be available for controlling the hydraulic components of a work vehicle;

FIG. 7 illustrates a view of one embodiment of a suitable operator interface that may be provided to an operator for controlling one or more aspects of a work vehicle's operation, including the selection of-hydraulic settings for controlling the hydraulic components of the work vehicle.

DETAILED DESCRIPTION OF THE INVENTION

Figure 1:
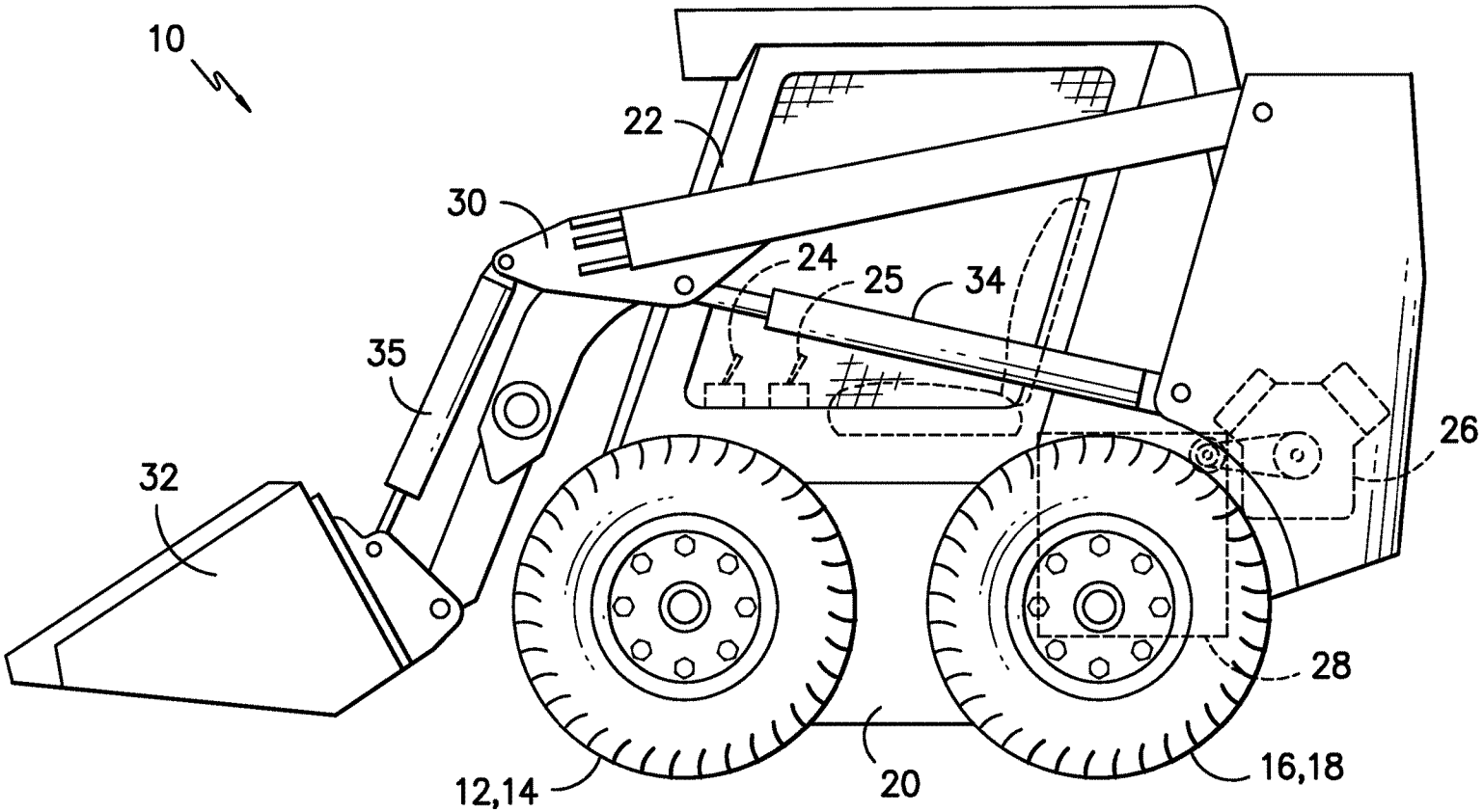
FIG. 1 illustrates a side view of one embodiment of a work vehicle.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a system and method for controlling the operation of at least one hydraulic component of a work vehicle, Specifically, in several embodiments, a plurality of electro-hydraulic (EH) settings may be stored within the memory of a controller of the work vehicle, For instance, one or more pre-defined EH settings may be stored within the controller's memory that correspond to fixed speed and/or sensitivity settings for the hydraulic component(s) of the work vehicle. The pre-defined EH settings may, for example, be manufacturer recommended settings that are pre-stored within the controller's memory. In addition, one or more customized EH settings may also be stored within the controller's memory that correspond to operator-selected speed and/or sensitivity settings for the hydraulic component(s) of the work vehicle. For instance, as will be described below, an operator may be allowed to select from a plurality of different combinations of speed and/or sensitivity settings for each hydraulic component in order to define a customized EH setting. This customized EH setting may then be stored within the controller's memory for subsequent use in controlling the hydraulic component(s).

Additionally, in accordance with aspects of the present subject matter, the stored EH settings may be made readily available for selection by an operator via a suitable input device(s) associated with an operator interface of the work vehicle, For instance, in one embodiment, the operator may simply be required to press one or more buttons located on the vehicle's control panel or instrument cluster to navigate between and/or select one of the stored EH settings. Accordingly, through use of the disclosed system and method, an operator may be allowed to easily and efficiently select and/or change the EH settings in order to quickly adapt the operation of the vehicle's hydraulic components to the manner of operation desired by the operator. As a result, the time required to change and/or set a work vehicle's EH settings may be reduced significantly, thereby reducing vehicle downtime.

Figure 2:
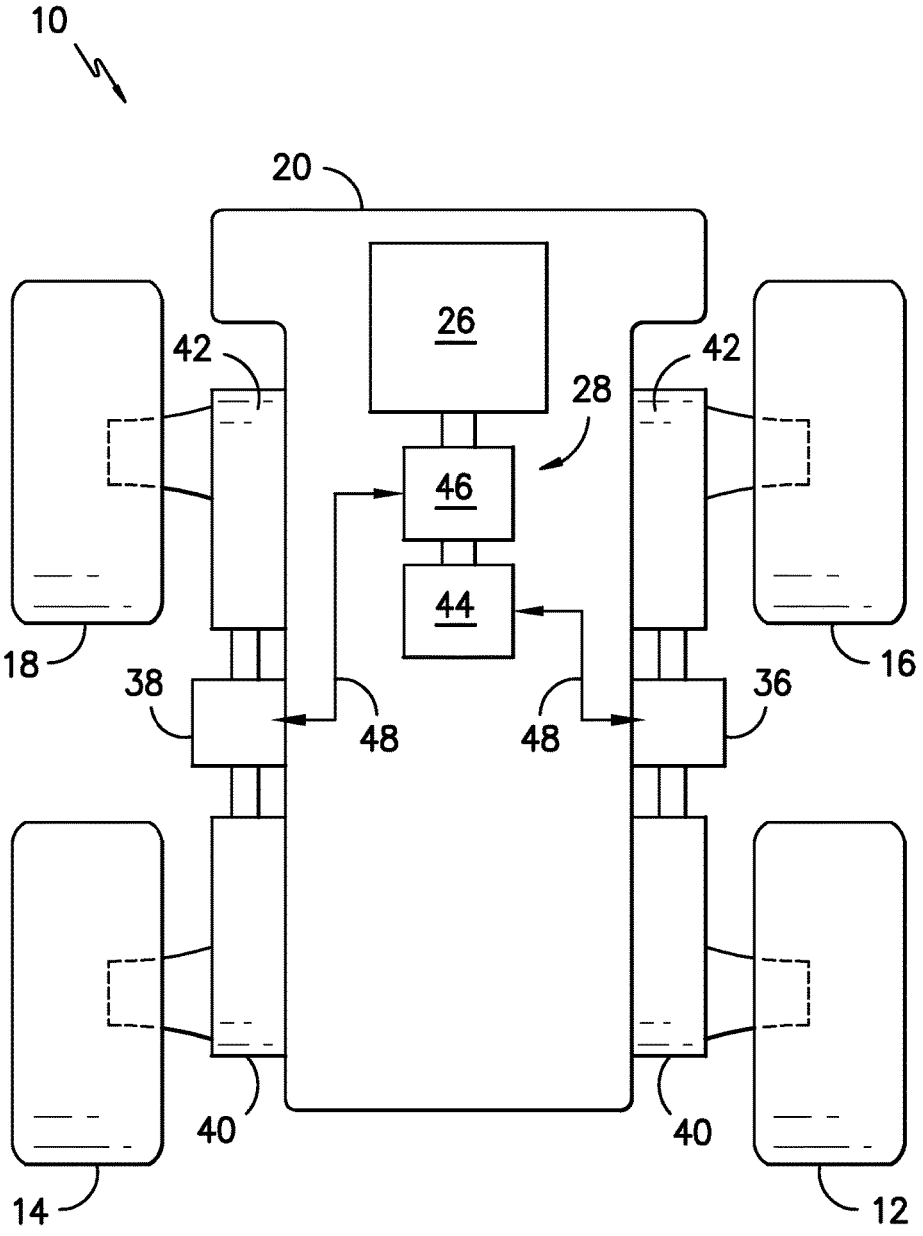
FIG. 2 illustrates a schematic view of various components of the work vehicle shown in FIG. 1, including a hydrostatic drive unit of the work vehicle.

Referring now to the drawings, FIGS. 1 and 2 illustrate different views of one embodiment of a work vehicle 10. Specifically, FIG. 1 illustrates a side view of the work vehicle 10 and FIG. 2 illustrates a schematic view of various components of the work vehicle 10 shown in FIG. 1. As shown, the work vehicle 10 is configured as a skid steer loader. However, in other embodiments, the work vehicle 10 may be configured as any other suitable work. vehicle known in the art, such as various agricultural vehicles, earth-moving vehicles, road vehicles, all-terrain vehicles, off road vehicles and/or the like.

As shown, the work vehicle 10 includes a pair of front wheels 12, 14, a pair of rear wheels 16, 18 and a chassis 20 coupled to and supported by the wheels 12, 14, 16, 18. An operator's cab 22 may be supported by a portion of the chassis 20 and may house various input devices, such as one or more speed control lever(s) 24 and one or more lift/tilt lever(s) 25, for permitting an operator to control the operation of the work vehicle 10, In addition, the work vehicle 10 may include an engine 26 and a hydrostatic drive unit 28 coupled to or otherwise supported by the chassis 20.

Moreover, as shown in FIG. 1, the work vehicle 10 may include a pair of loader arms 30 (one of which is shown) coupled between the chassis 20 and a suitable implement 32 (e.g., a bucket, fork, blade and/or the like). Hydraulic cylinders 34, 35 may also be coupled between the chassis 20 and the loader arms 30 and between the loader arms 30 and the implement 32 to allow the implement 32 to be raised/lowered and/or pivoted relative to the ground, For example, a lift cylinder 34 may be coupled between the chassis 20 and each loader arm 30 for raising and lowering the loader arms 30, thereby controlling the height of the implement 32 relative to the ground. Additionally, a tilt cylinder 35 may be coupled between each loader arm 30 and the implement 32 for pivoting the implement 32 relative to the loader arms 30, thereby controlling the tilt or pivot angle of the implement 32 relative to the ground.

As particularly shown in FIG. 2, the hydrostatic drive unit 28 of the work vehicle 10 may include a pair of hydraulic motors (e.g., a first hydraulic motor 36 and a second hydraulic motor 38), with each hydraulic motor 36, 38 being configured to drive a pair of wheels 12, 14, 16, 18, For example, the first hydraulic motor 36 may be configured to drive the left-side wheels 12, 16 via front and rear axles 40, 42, respectively, Similarly, the second hydraulic motor 38 may be configured to drive the right-side wheels 14, 18 via front and rear axles 40, 42, respectively, Alternatively, the motors 36, 38 may be configured to drive the wheels 12, 14, 16, 18 using any other suitable means known in the art. For instance, in another embodiment, the motors 36, 38 may be coupled to the wheels via a suitable sprocket/chain arrangement (not shown) as opposed to the axles 40, 42 shown in FIG. 1.

Additionally, the hydrostatic drive unit 28 may include a pair of hydraulic pumps (e.g., a first hydraulic pump 44 and a second hydraulic pump 46) driven by the engine 26, which may, in turn, supply pressurized fluid to the motors. For example, as shown in FIG. 2, the first hydraulic pump 44 may be fluidly connected to the first motor 36 (e.g., via a suitable hydraulic hose or other fluid. coupling 48) while the second hydraulic pump 46 may be fluidly connected to the second motor 38 (e.g., via a suitable hydraulic hose or other fluid coupling 48). As such, by individually controlling the operation of each pump 44, 46, the speed of the left-side wheels 12, 16 may be regulated independent of the right-side wheels 14, 18.

It should be appreciated that the configuration of the work vehicle 10 described above and shown in FIGS. 1 and 2 is provided only to place the present subject matter in an exemplary field of use. Thus, it should be appreciated that the present subject matter may be readily adaptable to any manner of work vehicle configuration.

Figure 3:
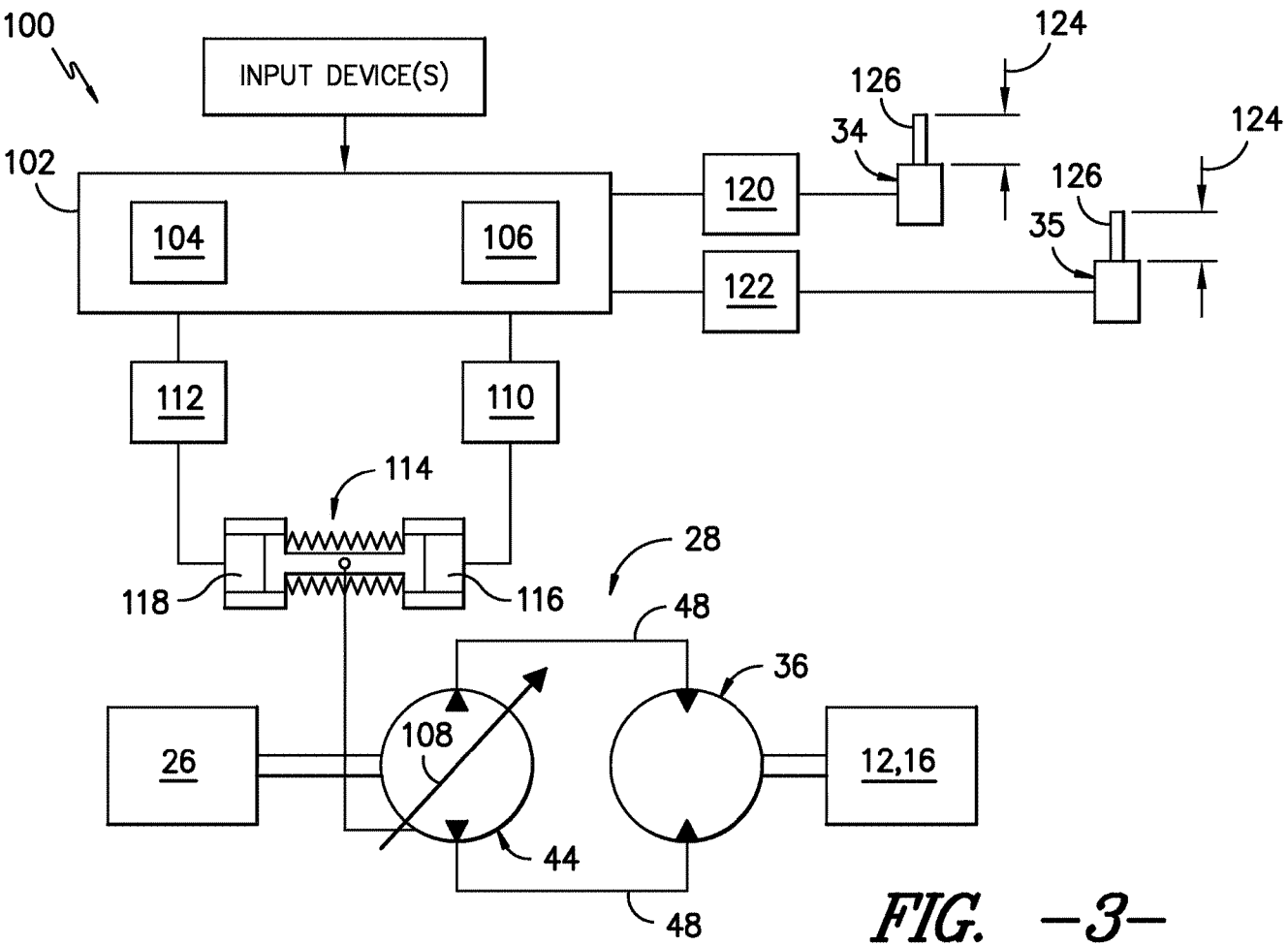
FIG. 3 illustrates a schematic view of one embodiment of a suitable control system for controlling various components of a work vehicle in accordance with aspects of the present subject matter, particularly illustrating the control system configured for controlling the hydraulic components of the work vehicle.

Referring now to FIG. 3, one embodiment of a control system 100 suitable for controlling the various components of a work vehicle is illustrated in accordance with aspects of the present subject matter. In general, the control system 100 will be described herein with reference to the work vehicle 10 described above with reference to FIGS. 1 and 2, However, it should be appreciated by those of ordinary skill in the art that the disclosed system 100 may generally be utilized to the control one or more components of any suitable work vehicle.

As shown, the control system 100 includes a controller 102 configured to electronically control the operation of one or more components of the work vehicle 10, such as the various hydraulic components of the work vehicle 10 (e.g., the hydrostatic unit 28, the lift cylinder 34 and the tilt cylinder 35). In general, the controller 102 may comprise any suitable processor-based device known in the art, such a computing device or any suitable combination of computing devices. Thus, in several embodiments, the controller 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as the method 400 described below with reference to FIG. 6. in addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

As shown in FIG. 3, the controller 102 may be communicatively coupled to various components for controlling the operation of the hydraulic pumps 44, 46 (and, thus, the hydraulic motors 36, 38) of the hydrostatic drive unit 28. Specifically, the controller 102 is shown in the illustrated embodiment as being coupled to suitable components for controlling the operation of the first hydraulic pump 44 and the first hydraulic motor 36, thereby allowing the controller 102 to electronically control the speed of the left-side wheels 12, 16, However, it should be appreciated that the controller 102 may also be communicatively coupled to similar components for controlling the operation of the second hydraulic pump 46 and the second hydraulic motor 38, thereby allowing the controller 102 to electronically control the speed of the right-side wheels 14, 18.

As indicated above, the hydraulic pump 44 may be driven by the engine 26 and may be fluidly connected to the hydraulic motor 36 via suitable fluid couplings 48 (e.g., hydraulic hoses), The hydraulic motor 36 may, in turn, drive the left-side wheels 12, 16 of the vehicle. In several embodiments, the motor 36 may be configured as a fixed displacement motor while the hydraulic pump 44 may be configured as a variable displacement pump. Accordingly, to change the rotational speed of the motor 36 (and, thus, the rotational speed of the wheels 12, 16), the displacement of the hydraulic pump 44 may be varied by adjusting the position or angle of a swashplate (indicated by the arrow 108) of the pump 44, thereby adjusting the flow of hydraulic fluid to the motor 36.

To electronically control the displacement of the swashplate 108, the controller 102 may be commutatively coupled to suitable pressurize regulating valves 110, 112 (PRVs) (e.g., solenoid-activated valves) configured to regulate the pressure of hydraulic fluid supplied to a control piston 114 of the pump 44. Specifically, as shown schematically in FIG. 3, the controller 102 may be coupled to both a forward PRV 110 configured to regulate the pressure of the hydraulic fluid supplied to a forward chamber 116 of the control piston 114 and a reverse PRV 112 configured to regulate the pressure of the hydraulic fluid supplied to a reverse chamber 118 of the control piston 114. By pressurizing the forward chamber 116, the swashplate 108 of the pump 44 may be displaced such that hydraulic fluid flows through the fluid loop defined by the hydrostatic drive unit 28 in a manner that causes the motor 36 to drive the wheels 12, 16 in the forward direction. Similarly, by pressurizing the reverse chamber 118, the swashplate 108 may be displaced such that hydraulic fluid flows through the fluid loop in a manner that causes the motor 36 to drive the wheels 12, 16 in the reverse direction.

As is generally understood, the current supplied to each PRV 110, 112 is directly proportional to the pressure supplied to its corresponding chamber 116, 118, the pressure difference of which is, in turn, directly proportional to the displacement of the swashplate 108. Thus, for example, by increasing the current command to the forward PRV 110 by a given amount, the pressure within the forward chamber 116 and, thus, the angle of the swashplate 108 may be increased by a proportional amount(s). As the angle of the swashplate 108 is increased, the flow of hydraulic fluid supplied to motor 36 is similarly increased, thereby resulting in an increase in the rotational speed of the wheels 12, 16 in the forward direction. A similar control strategy may be used to increase the rotational speed of the wheels 12, 16 in the reverse direction by increasing the current command supplied to the reverse PRV 112.

In addition, the controller 102 may be configured to similarly control the operation of the hydraulic lift and tilt cylinders 34, 35. For example, in several embodiments, the controller 102 may be commutatively coupled to suitable pressurize regulating valves 120, 122 (PRVs) (e.g., solenoid-activated valves) configured to regulate the pressure of the hydraulic fluid supplied to each cylinder 34, 35. Specifically, as shown schematically in FIG. 3, the controller 102 may be coupled to both a lift PRV 120 configured to regulate the pressure of the hydraulic fluid supplied to the lift cylinder 34 and a tilt PRV 122 configured to regulate the pressure of the hydraulic fluid supplied to the tilt cylinder 35. In such an embodiment, the current supplied to each PRV 120, 122 may be directly proportional to the pressure supplied to its corresponding cylinder 34, 35, thereby allowing the controller 102 to control the displacement of each cylinder 34, 35 (and, thus, the height and/or tilt angle of the implement 32 relative to the ground). For example, by carefully regulating the current supplied to each PRV 120, 122, the controller 102 may be configured to control a displacement length 124 of a piston rod 126 of each cylinder 34, 35 as the rod 126 is extended and retracted with changes in the hydraulic pressure supplied to the cylinders 34, 35.

It should be appreciated that the current commands provided by the controller 102 to the various PRVs 110, 112, 120, 122 may be in response to inputs provided by the operator via one or more input devices. For example, one or more input devices (e.g., the speed lever(s) 24 shown in FIG. 1) may be provided within the cab 22 to allow the operator to provide operator inputs associated with controlling the speed and/or direction of travel of the vehicle 10 (e.g., by varying the current commands supplied to the forward and/or reverse PRVs 110, 112 based on operator-initiated changes in the position of the speed lever(s) 24). Similarly, one or more input devices (e.g., the lift/tilt lever(s) 25 shown in FIG. 1) may be provided within the cab 22 to allow the operator to provide operator inputs associated with controlling the position of the implement 32 relative to the ground (e.g., by varying the current commands supplied to the lift and/or tilt PRVs 120, 122 based on operator-initiated changes in the position of the lift/tilt lever(s) 25).

Moreover, in accordance with aspects of the present subject matter, the controller 102 may also be configured to store a plurality of different electro hydraulic (EH) settings that allow the operator to vary the manner in which the hydraulic components of the vehicle 10 are controlled. Specifically, as will be described below, one or more pre-defined EH settings may be stored within the controller's memory 106 that correspond to fixed speed and/or sensitivity settings for the vehicle's hydraulic components. Moreover, in addition to the pre-defined EH settings, the operator may be allowed to store one or more customized EH settings within the controller's memory 106 that correspond to operator-defined speed and/or sensitivity settings for the vehicle's hydraulic components.

Referring now to FIG. 4, a chart is illustrated providing a plurality of example speed and sensitivity settings that may be available for controlling the operation of the hydraulic components of the work vehicle 10. Specifically, as shown in FIG. 4, various speed settings may be available for each hydraulic component (e.g., the hydrostatic drive unit 28, the lift cylinder 34 and the tilt cylinder 35). For example, in one embodiment, the hydrostatic drive unit 28 may include a low speed setting (box 202), a first medium speed setting (box 204), a second medium speed setting (box 205) and a high speed setting (box 208). In such an embodiment, each speed setting may generally correspond to a rotational speed range across which the motors 36, 38 of the hydrostatic unit 28 may be operated, with the maximum rotational speed within each speed range increasing from the low speed setting 202 to the high speed setting 208. For example, at the "high" speed setting 208, the rotational speed of each motor 36, 38 may be increased from a zero speed to a predetermined maximum speed as the speed control lever 24 of the work vehicle 10 is moved across its permitted range of movement (e.g. a speed range extending from 0 MPH to 10 MPH). Similarly, at the "low" speed setting 202, the rotational speed of each motor 36, 38 may be increased from a zero speed to a predetermined maximum speed that is lower than the maximum speed for the high speed setting 208 (e.g. a speed range extending from 0 MPH to 4 MPH). Moreover, at the "first medium" and "second medium" speed settings 204, 206, the rotational speed of each motor 36, 38 may be increased from a zero speed to predetermined maximum speeds defined between the maximum speeds for the high and low speed settings 208, 202 (e.g. a speed range extending from 0 MPH to 6 MPH for the first medium setting and a speed range extending from 0 MPH to 8 MPH for the second medium setting).

Additionally, as shown in FIG. 4, the lift and tilt cylinders 34, 35 may each include a low speed setting (boxes 210 and 212), a first medium speed setting (boxes 214 and 216), a second medium speed setting (boxes 218 and 220) and a high speed. setting (boxes 222 and 224). In such an embodiment, each speed setting may correspond to the rate at which the displacement length 124 of each cylinder 34, 35 may be changed as the implement 32 is raised/lowered and/or tilted relative to the ground. For example, at the "high" speed settings 222, 224, the allowable rate of change for the displacement length 124 of each cylinder 34, 35 may be set at a relatively high level (e.g. a cycle time of 2 seconds for the piston rod 126 to travel the entire displacement length 124). Similarly, at the "low" speed settings 210, 212, the allowable rate of change for the extension length 124 of each cylinder 34, 35 may be set at a relatively low level (e.g. a cycle time of 8 seconds for the piston rod 126 to travel the entire displacement length 124). Moreover, at the "first medium" and "second medium" speed settings 214, 216, 218, 220, the allowable rate of change of the extension length 124 of each cylinder 34, 35 may be set at respective intermediate levels (e.g. a cycle time of 6 seconds for the piston rod 126 to travel the entire displacement length 124 for the first medium speed settings and a cycle time of 4 seconds for the piston rod 126 to travel the entire displacement length 124 for the second medium speed settings).

Referring still to FIG. 4, various sensitivity settings may also be available for controlling the hydraulic, components, For example, in one embodiment, both the hydrostatic drive unit 28 and the lift/tilt cylinders 34, 35 may include a low sensitivity setting (boxes 230 and 232), a medium sensitivity setting (boxes 234 and 236) and a high sensitivity setting (boxes 238 and 240). In such an embodiment, each sensitivity setting may correspond to the sensitivity or resolution of the input devices used to control the hydraulic components. For example, the sensitivity settings associated with the hydrostatic drive unit 28 may correspond to the responsiveness of the rotational speed of the motors 36, 38 to changes in the position of the speed control lever(s) 24. Similarly, the sensitivity settings associated with the tilt and lift cylinders 34, 35 may correspond to the responsiveness of the cylinder displacements 124 to changes in the position of the lift/tilt lever(s) 25. Thus, at the "high" sensitivity settings 238, 240, the rotational speed of the motors 38, 38 and the displacement 124 of the lift/tilt cylinders 34, 35 may be highly sensitive to changes in the position of their corresponding control levers 24, 25 whereas, at the "low" sensitivity settings 230, 232, the rotational speed of the motors 38, 38 and the displacement 12 of the lift/tilt cylinders 34, 35 may be significantly less sensitive to changes in the position of the corresponding control levers 24, 25. Similarly, at the "medium" sensitivity settings 234, 236, the rotational speed of the motors 38, 38 and the displacement 124 of the lift/tilt cylinders 34, 35 may have sensitivities to changes in the position of their corresponding control levers 24, 25 that are in-between the sensitivities associated with the low and high sensitivity settings 230, 232, 238, 240.

It should be appreciated that, although a specific number of speed and sensitivity settings are shown for each hydraulic component, any suitable number of speed/sensitivity settings may be available for the hydraulic components. For instance, in an alternative embodiment, each hydraulic component may only include three speed settings (e.g., a high, medium and low speed setting).

It should also be appreciated that, given the amount of speed/sensitivity settings available for each hydraulic component(s), a significant number of different combinations of EH settings may be provided to the operator. For instance, in the illustrating embodiment, 576 different combinations of speed and sensitivity settings are available for controlling the hydrostatic drive unit 28 as well as the loader arms 30 and implement 32 (via the lift and tilt cylinders 34, 35).

Thus, to simplify the process of selecting EH settings for the hydraulic components, a plurality of specific combinations of EH settings may be stored within the controller's memory 106 and may be made easily accessible to the operator for selection thereof, Specifically, as indicated above, the controller 102 may be provided with one or more predefined EH settings corresponding to a fixed combination(s) of speed and/or sensitivity settings. For instance, in a particular embodiment, the predefined EH settings may correspond to manufacturer recommended settings that are pre-stored within the controller's memory 106.

Figure 5:
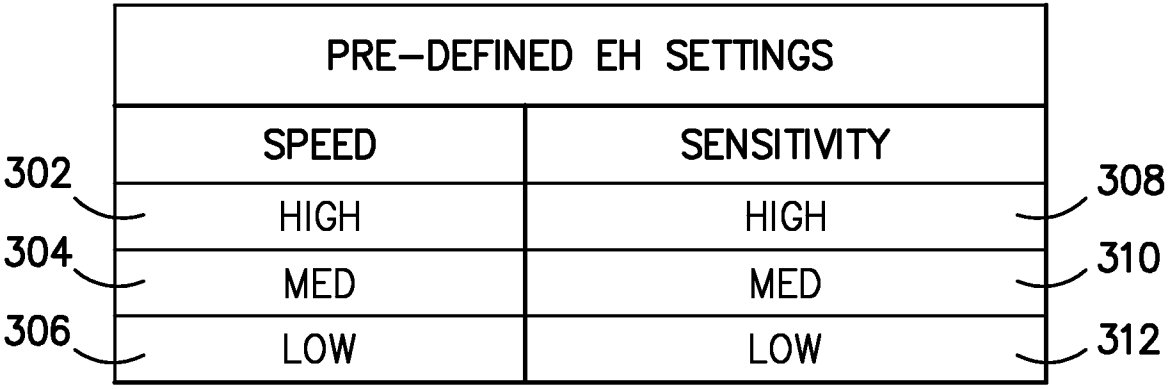
FIG. 5 illustrates a chart providing example pre-defined electro-hydraulic settings that may be stored within the memory of a controller of a work vehicle in accordance with aspects of the present subject matter.

FIG. 5 illustrates a chart providing examples of suitable predefined EH settings that may be stored within the controller's memory 106. As shown in FIG. 5, the pre-defined EH settings may include a plurality of pre-defined speed settings 302, 304, 306 and a plurality of predefined sensitivity settings 308, 310, 312. Specifically, as shown in the illustrated embodiment, the pre-defined speed settings include a high speed setting 302, a medium speed setting 304 and a low speed setting 306. In such an embodiment, at the pre-defined high speed setting 302, each of the hydraulic components may be configured to be operated at its individual "high" speed setting (e.g., boxes 208, 222 and 224 in FIG. 4). Similarly, at the pre-defined low speed setting 306, each of the hydraulic components may be configured to be operated at its individual "low" speed setting (e.g., boxes 202, 210 and 212 in FIG. 4). Moreover, at the pre-defined medium speed setting 304, each of the hydraulic components may be configured to be operated at one of its individual "medium" speed settings (e.g., boxes 204, 214 and 216 or boxes 206, 218 and 220 in FIG. 4). Thus, each pre-defined speed setting 302, 304, 306 may correspond to a combination of the individual speed settings for the hydrostatic drive unit 28, the lift cylinder 34 and the tilt cylinder 35.

Additionally, as shown in the illustrated embodiment, the pre-defined sensitivity settings include a high sensitivity setting 308, a medium sensitivity setting 310 and a low sensitivity setting 312. In such an embodiment, at the pre-defined high sensitivity setting 308, each of the hydraulic components may be configured to be operated at its individual "high" sensitivity setting (e.g., boxes 238 and 240 in FIG. 4). Similarly, at the predefined low sensitivity setting 312, each of the hydraulic components may be configured to be operated at its individual "low" sensitivity setting (e.g., boxes 230 and 232 in FIG. 4). Moreover, at the pre-defined medium speed setting 310, each of the hydraulic components may be configured to be operated at its individual "medium" sensitivity setting (e.g., boxes 234 and 236 in FIG. 4). Thus, each pre-defined sensitivity setting 308, 310, 312 may correspond to a combination of the individual sensitivity settings for the hydrostatic drive unit 28 and the lift/tilt cylinders 34, 35.

It should be appreciated that the EH settings shown in FIG. 5 are simply illustrated to provide examples of suitable pre-defined EH settings that may be stored within the controller's memory 106, However, in other embodiments, the controller 102 may be provided with any other suitable type and/or number of pre-defined EH settings. For instance, instead of including three predefined speed settings, the controller 102 may be provided with four pre-defined speed settings to match the four individualized speed settings available for each hydraulic component (e.g., high, first medium, second medium and low pre-defined speed settings).

Additionally, as indicated above, one or more customized EH settings may also be stored within the controller's memory 106, In general, each customized EH setting may correspond to an operator-defined combination of speed and/or sensitivity settings for the vehicle's hydraulic components. For example, as indicated above with reference to the embodiment shown in FIG. 4, 576 different combinations are available given the various speed and sensitivity settings provided for the hydraulic components. In such an embodiment, each customized EH setting may correspond to one of the possible 576 combinations. For instance, to create a customized speed setting, the operator may be allowed select a specific speed setting for the hydrostatic drive unit 28 (e.g., one of the boxes 202, 204, 206, 208 shown in FIG. 4), a specific speed setting for the lift cylinder 34 (e.g., one of the boxes 210, 214, 218, 222 shown in FIG. 4) and a specific speed setting for the tilt cylinder 25 (e.g., one of the boxes 212, 216, 220, 224 shown in FIG. 4). Similarly, to create a customized sensitivity setting, the operator may be allowed select a specific sensitivity setting for the hydrostatic drive unit 28 (e.g., one of the boxes 230, 234, 238 shown in FIG. 4) and a specific sensitivity setting for the lift/tilt cylinders 34, 35 (e.g., one of the boxes 232, 236, 240 shown in FIG. 4).

Figure 6:
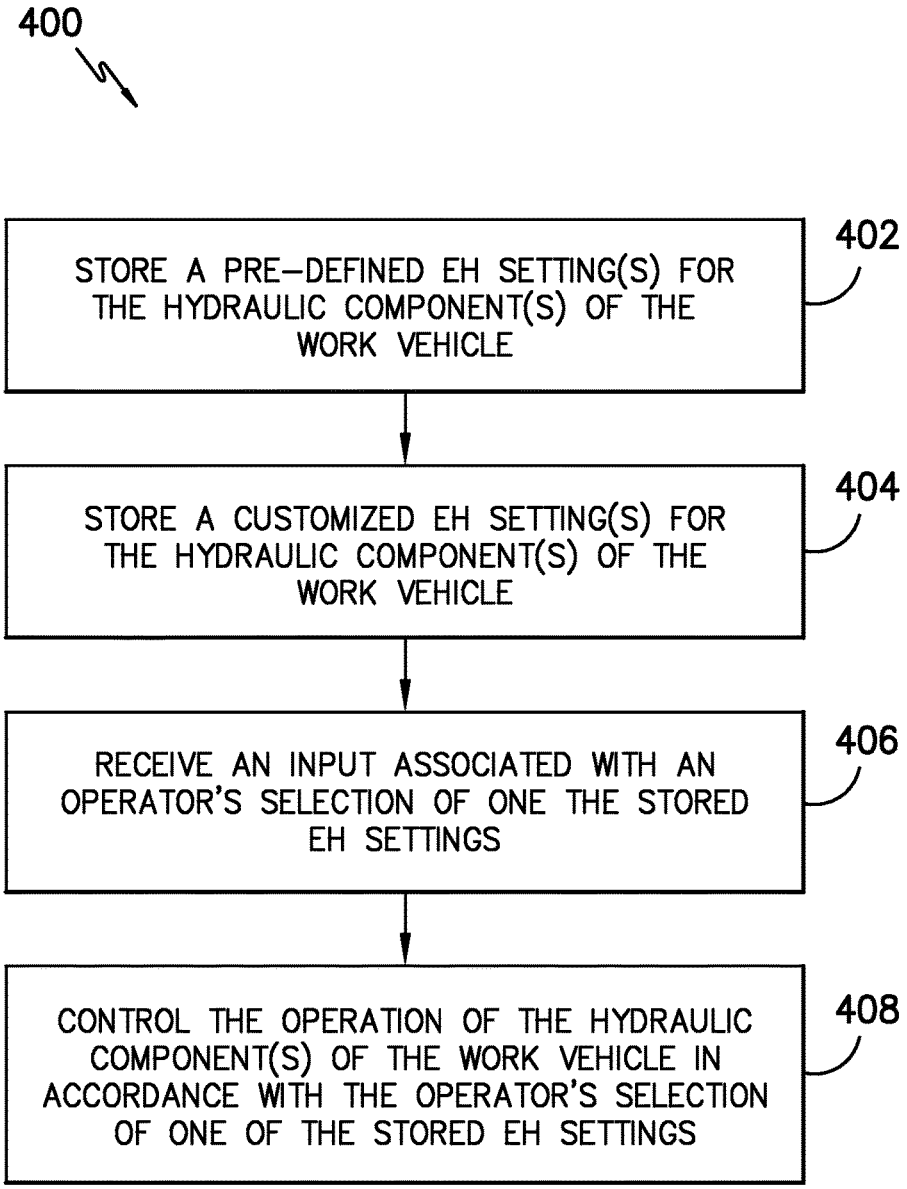
FIG. 6 illustrates a flow diagram of one embodiment of a method for controlling the operation of one or more hydraulic components of a work vehicle in accordance with aspects of the present subject matter.

Referring now to FIG. 6, a flow diagram of one embodiment of a method 400 for controlling the operation of one or more hydraulic components of a work vehicle is illustrated in accordance with aspects of the present subject matter. in general, the method 400 will be described with reference to the work vehicle 10 and the control system 100 described above with reference to FIGS. 1-5. However, it should be appreciated by those of ordinary skill in the art that the disclosed method 400 may generally be utilized with any manner of work vehicle and/or associated control system. In addition, although FIG. 6 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure, As shown in FIG. 6, at (402), the method 400 includes storing a pre-defined EH setting(s) for the hydraulic component(s) of the work vehicle 10. Specifically, as indicated above, one or more pre-defined EH settings may be stored within the controller's memory 106, with each pre-defined EH setting corresponding to a specific combination of speed and/or sensitivity settings for the various hydraulic component(s). For instance, referring back to FIG. 5, in one embodiment, low, medium and high pre-defined speed settings 302, 304, 306, as well as low, medium and high pre-defined sensitivity settings 308, 310, 312 may be stored within the controller's memory 106. As indicated above, such pre-defined EH settings may, for example, correspond to manufacturer recommended settings that are pre-stored inside the controller 102.

Additionally, at (404), the method 400 includes storing a customized EH setting(s) for the hydraulic component(s) of the work vehicle 10. As indicated above, each customized EH setting may generally correspond to a specific combination of operator-selected speed and/or sensitivity settings. For example, in one embodiment, the operator may be allowed to select a specific speed and/or sensitivity setting for each hydraulic component of the work vehicle 10. The selected combination(s) of speed and/or sensitivity settings may then be stored within the controller's memory 106 as the operator's customized EH setting(s).

It should be appreciated that the operator may be allowed to select each combination of speed and sensitivity settings and save such combination(s) as a customized EH setting(s)

within the controller's memory 106 using any suitable input device(s) available to the operator within the cab 22. For example, as will be described below, the operator may be provided one or more buttons on the control panel or instrument cluster of the work vehicle 10 that permit the operator to navigate through and/or select menus (and sub-menus) and/or settings associated with the vehicle's operation. In such an embodiment, the operator may be provided access to a set-up menu associated with the vehicle's EH settings to allow the operator to select and save one or more customized EH settings for controlling the vehicle's hydraulic components. Alternatively, any other suitable input devices may be utilized by the operator to select/save a customized EH setting, such as a suitable knob(s), lever(s), touch screen(s) and/or the like.

It should also be appreciated that, in several embodiments, the controller 102 may be configured to determine whether one or more predetermined safety conditions are satisfied prior to providing an operator access to the menus and/or sub-menus associated with selecting and saving a customized EH setting within the controller's memory 106. For instance, in one embodiment, the controller 102 may be configured to verify that the operator is seated within the cab 22 (e.g., via a sensor associated with the operator's seat) and/or that the vehicle 10 is in a parked condition (e.g., by determining whether the parking brake is engaged). In another embodiment, the controller 102 may be configured to verify that any other suitable predetermined conditions are satisfied prior to allowing the operator to select/save a customized EH setting.

Additionally, it should be appreciated that, in several embodiments, each operator may be allowed store his/her own customized EH settings within the controller's memory 106. In such embodiments, when a particular operator is operating the work vehicle 10, the operator may log-in (e.g., by providing an operator code, ID and/or password) or may otherwise provide the controller 102 an indication that the operator is associated with one or more specific customized EH settings stored within the controller's memory 106. The controller 102 may then make such customized EH setting(s) available for the operator's selection.

It should also be appreciated that, as used herein, the controller 102 may be "storing" the pre-defined and/or customized EH settings at any time that such settings are contained within the controller's memory 106. Thus, the terms "store" and "storing" need not be limited to the initial act of recording or saving an EH setting within the controller's memory 106.

Moreover, at (406), the method 400 includes receiving an input associated with an operator's selection of one of the stored EH settings. Specifically, in several embodiments, one or more suitable input devices included within the operator interface of the work vehicle 10 may be provided to allow the operator to select one of the pre-defined EH settings or one of the customized EH settings stored within the controller's memory 106. In such embodiments, it should be appreciated that the specific input device(s) provided for selecting one of the stored EH settings may generally vary from vehicle-to-vehicle depending on the type and configuration of the operator interface available within the operator's cab 22.

For instance, FIG. 7 illustrates a simplified view of one embodiment of a suitable operator interface 500 that may be provided as part of the control panel or instrument cluster of the work vehicle 10 to allow for the selection of one of the stored EH settings. As shown, the interface 500 includes a plurality of input buttons, such as a power button 502, a start button 504, an auxiliary override button. 506 and an operate button 508. In addition, the interface 500 includes a plurality of display features configured to provide the operator a visual indication of the operating conditions and/or settings of the work vehicle 10. For instance, as shown in FIG. 7, the interface 500 includes a plurality of gauges (e.g., a water temperature gauge 510, an oil temperature gauge 512 and a fuel gauge 514) as well as a plurality of indicator or warning lights 516. Moreover, the interface 500 includes a display window 518 for displaying textual messages to the operator, such as messages providing the operator an indication of the current menu (or sub-menu) through which he/she is navigating.

In the embodiment shown in FIG. 7, an operator may be able to access an EH settings menu associated with the stored EH settings by pressing one or more of the input buttons provided on the operator interface 500 (e.g., by holding the auxiliary override button 506 for a period of time, such as two seconds). Once in the EH settings menu, the operator may be able to toggle between the different types of EH settings (e.g., speed and sensitivity) in order to select a sub-menu for accessing the specific settings associated with each setting type. In such an embodiment, the currently available settings menu may be displayed in the display window 518. For example, as shown in FIG. 7, a message of "SPEED" is provided in the display window 518, thereby indicating that the operator may provide a suitable input (e.g., by pressing the operator button 508) to access to the sub-menu associated with the EH speed settings. Once in the speed sub-menu, the operator may be allowed to select one of the stored EH speed settings, such as one of the pre-defined speed settings, (e.g., one of the high, medium or low speed settings shown as boxes 302, 304, 306 in FIG. 5) or one of the customized speed settings. Similarly, by accessing the sub-menu associated with the EH sensitivity settings, the operator may be allowed to select one of the stored sensitivity settings, such as one of the pre-defined EH sensitivity settings (e.g., one of the high, medium or low sensitivity settings shown as boxes 308, 310, 312 in FIG. 5) or one of the customized EH sensitivity settings. Upon the selection of one of the stored EH settings, the selected setting may be stored as the active EH setting for the controller 102.

In alternative embodiments, any other suitable input device(s) may be provided to allow an operator to select one of the EH settings stored within the controller's memory 106. For instance, in one embodiment, a series of buttons may be provided on the control panel or within instrument cluster of the work vehicle 10, with each button corresponding to a different stored EH setting. In another embodiment, one or more knobs may be provided that allow the operator to select a stored EH setting(s) by turning the knob(s) to the appropriate position. In a further embodiment, a touch screen may be provided that allows the operator to navigate the various EH settings menus by using touch-related inputs directed to the screen. Of course, one of ordinary skill in the art should readily appreciate that any other suitable type and/or configuration of input device(s) may be provided to allow an operator to select one of the stored EH settings.

It should also be appreciated that, in several embodiments, the controller 102 may be configured to determine whether one or more predetermined safety conditions are satisfied prior to providing an operator access to the menus and/or sub-menus associated with selecting one of the stored EH settings. For instance, in one embodiment, the controller 102 may be configured to verify that the operator is seated within the cab 22 (e.g., via a sensor associated with the operator's set) and/or that the vehicle 10 is in a parked condition (e.g., by determining whether the parking brake is engaged). In another embodiment, the controller 102 may be configured to verify that any other suitable predetermined conditions are satisfied prior to allowing the operator to select/save a customized EH setting, such as whether the vehicle's hydraulics are currently disabled, whether any unacknowledged faults exists within the system 100 and/or whether the auxiliary override for the vehicle 10 is active.

Referring back to FIG. 6, at (408), the method 400 includes controlling the operation of the hydraulic component(s) of the work vehicle 10 in accordance with the operator's selection of one of the stored EH settings. Specifically, if the operator selects one of the predefined speed settings or one of the customized speed settings as the active speed setting(s) for the work vehicle 10, the controller 102 may be configured to control the operation of the hydrostatic drive unit 28, the lift cylinder 34 and the tilt cylinder 35 in accordance with the speed setting(s) associated with the active seed setting. For example, upon the selection of the predefined high speed setting (e.g., box 302 in FIG. 5), the controller 102 may be configured to control the operation of the hydraulic components in a manner consistent with the individual high speed settings for such components (e.g., boxes 208, 222 and 224 in FIG. 4). Similarly, if the operator selects one of the predefined sensitivity settings or one of the customized sensitivity settings as the active sensitivity setting for the vehicle 10, the controller 102 may be configured to control the operation of the hydraulic components in accordance with the sensitivity settings associated with the active sensitivity setting. For instance, upon the selection of the pre-defined low sensitivity setting (e.g., box 312 in FIG. 5), the controller 102. may be configured to control the operation of the hydrostatic drive unit 28 and the lift/tilt cylinders 34, 35 in a manner consistent with the individual low sensitivity settings for such components (e.g., boxes 230 and 232 in FIG. 4).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A computer-implemented method for controlling the operation of at least one hydraulic component of a work vehicle, the work vehicle including a hydrostatic drive unit configured to rotationally drive associated wheels of the work vehicle and one or more hydraulic cylinders configured to adjust a position or at least on of a loader arm or an implement of the work vehicle, the method comprising:

storing, with a computing device, a plurality of first electro-hydraulic settings for the hydrostatic drive unit and the one or more hydraulic cylinders of the work vehicle, each of the plurality of first electro-hydraulic settings including a combination of both a unique individual electro-hydraulic setting for the hydrostatic drive unit and a unique individual electro-hydraulic setting for the one or more hydraulic cylinders;

receiving, with the computing device, a first input associated with selecting a desired individual electro-hydraulic setting for the hydrostatic drive unit from one of the plurality of first electro-hydraulic settings;

receiving, with the computing device, a second input associated with selecting a desired individual electro-hydraulic setting for the one or more hydraulic cylinders from a different one of the plurality of first electro-hydraulic settings;

storing, with the computing device, a combination of the desired individual electro-hydraulic setting for the hydrostatic drive unit and the desired individual electro-hydraulic setting for the one or more hydraulic cylinders as a second electro-hydraulic setting;

receiving, with the computing device, a third input associated with an operator's selection of the second hydraulic setting;

actively controlling, with the computing device, the operation of the hydrostatic drive unit and the one or more cylinders in accordance with the desired individual electro-hydraulic settings associated with the second electro-hydraulic setting.

2. The method of claim 1, wherein the one or more hydraulic cylinders comprise a lift cylinder for raising and lowering the loader arm of the word vehicle and a tilt cylinder for tilting the implement relative to the loader arm.

3. The method of claim wherein each individual electro-hydraulic setting for the hydrostatic drive unit comprises one of a low speed setting, a medium speed setting or a high speed setting for the hydrostatic drive unit and wherein each individual electro-hydraulic setting for the one or more hydraulic cylinders comprises one of a low speed setting, a medium speed setting or a high speed setting for the one or more hydraulic cylinders.

4. The method of claim wherein each individual electro-hydraulic setting for the hydrostatic drive unit comprises one of a low sensitivity setting, a medium sensitivity setting and a high sensitivity setting for the hydrostatic drive unit and wherein each individual electro-hydraulic setting for the one or more hydraulic cylinders comprises one of a low sensitivity setting, a medium sensitivity setting and a high sensitivity setting for the one or more hydraulic cylinders.

5. The method of claim 1, wherein the plurality of first electro-hydraulic settings correspond to manufacturer recommended settings stored within the computing device.

6. The method of claim 1, further comprising verifying that one or more predetermined conditions for receiving a least one of the first input, the second input, or the third input are satisfied.

7. The method of claim 6, wherein the one or more predetermined conditions comprise at least one of an operator being seated within a cab of the work vehicle or the work vehicle being in a parked condition.

8. The method of claim 1, wherein the work vehicle is a skid steer loader.

9. A system for controlling one or more components of a work vehicle, the system comprising:

a hydrostatic drive unit configured to rotationally drive associated wheels of the work vehicle;

one or more hydraulic cylinders configured to adjust a position of at least one of a loader arm or an implement of the work vehicle;

a controller communicatively coupled to the hydrostatic drive unit and the one or more hydraulic cylinders, the controller being configured to:

store a plurality of first electro-hydraulic settings for the hydrostatic drive unit and the one or more hydraulic cylinders, each of the plurality of first electro-hydraulic settings including a combination of both a unique individual electro-hydraulic setting for the hydrostatic drive unit and a unique individual electro-hydraulic setting for the one or more hydraulic cylinders;

receive a first input associated with selecting a desired individual electro-hydraulic setting for the hydrostatic drive unit from one of the plurality of first electro-hydraulic settings;

receive a second input associated with selecting a desired individual electro-hydraulic setting for the one or more hydraulic cylinders from a different one of the plurality of first electro-hydraulic settings;

store a combination of the desired individual electro-hydraulic setting for the hydrostatic drive unit and the desired individual electro-hydraulic setting for the one or more hydraulic cylinders as a second electro-hydraulic setting;

receive an input associated with an operator's selection of the second hydraulic setting;

actively control the operation of the hydrostatic drive unit and the one or more hydraulic cylinders in accordance with the desired individual electro-hydraulic settings associated with the second electro-hydraulic setting.

10. The system of claim 9, wherein the one or more hydraulic cylinders comprise a lift cylinder for raising and lowering the loader arm of the work vehicle and a tilt cylinder for tilting the implement relative to the loader arm.

11. The system of claim 9, wherein each individual electro-hydraulic setting for the hydrostatic drive unit comprises one of a low speed setting, a medium speed setting or a high speed setting for the hydrostatic drive unit and wherein each individual electro-hydraulic setting for the one or more hydraulic cylinders comprises one of a low speed setting, a medium speed setting or a high speed setting for the one or more hydraulic cylinders.

12. The system of claim 9, wherein each individual electro-hydraulic setting for the hydrostatic drive unit comprises one of a low sensitivity setting, a medium sensitivity setting and a high sensitivity setting for the hydrostatic drive unit and wherein each individual electro-hydraulic setting for the one or more hydraulic cylinders comprises one of a low sensitivity setting, a medium sensitivity setting and a high sensitivity setting for the one or more hydraulic cylinders.

13. The system of claim 9, wherein the plurality of first electro-hydraulic settings correspond to manufacturer recommended settings stored within the computing device.

14. The system of claim 9, wherein the controller is further configured to verify that one or more predetermined conditions for receiving at least one of the first input, the second input, or the third input are satisfied.

15. The system of claim 14, wherein the one or more predetermined conditions comprise at least one of an operator being seated within a cab of the work vehicle or the work vehicle being in a parked condition.

16. The system of claim 9, wherein the work vehicle is a skid steer loader.

* * * * *